US005934130A

United States Patent [19]

Kajiwara et al.

[11] Patent Number: 5,934,130

[45] Date of Patent: Aug. 10, 1999

[54] ROLLING MILL DRIVE APPARATUS, ROLLING MILL AND ROLLING METHOD

[75] Inventors: Toshiyuki Kajiwara, Tokyo; Hidetoshi Nishi, Hitachi; Yasutsugu Yoshimura, Hitachi; Mitsuo Nihei, Hitachi; Toyotsugu Masuda, Hitachinaka; Kenji Yamamoto, Takahagi, all of Japan

[73] Assignee: Hitachi Ltd., Tokyo, Japan

[21] Appl. No.: 08/887,292

[22] Filed: Jul. 2, 1997

[30] Foreign Application Priority Data

Jul. 2, 1996 [JP] Japan ..... 8-172140
Dec. 11, 1996 [JP] Japan ..... 8-330667

[51] Int. Cl.[6] ..... B21B 31/07; B21B 35/00

[52] U.S. Cl. ..... 72/249; 476/31

[58] Field of Search ..... 72/8.4, 11.1, 14.3, 72/224, 225, 237, 241.2, 242.2, 242.4, 249, 442; 74/665 G; 476/31; 492/15

[56] References Cited

U.S. PATENT DOCUMENTS 2,039,959 5/1936 Iversen ..... 72/249
2,618,941 11/1952 Iversen ..... 72/249
3,098,403 7/1963 Metzger ..... 72/249
3,257,859 6/1966 Olbrich ..... 476/31
3,461,704 8/1969 Rastelli ..... 72/242.4
4,674,313 6/1987 Bald et al. ..... 72/249
5,634,257 6/1997 Kajiwara et al. ..... 72/201

FOREIGN PATENT DOCUMENTS 55-77916 6/1980 Japan .

*Primary Examiner*—Joseph J. Hail, III
*Assistant Examiner*—Rodney Butler
*Attorney, Agent, or Firm*—Evenson McKeown Edwards & Lenahan, PLLC

[57] ABSTRACT

A rolling mill drive apparatus for driving any rolls of a pair of work rolls, 2 to 4 intermediate rolls and 2 to 4 backup rolls comprises a drive roller without tooth, rotated by an electric motor, at least one driven roller without tooth, contacting with the drive roller, a load imparting device for imparting a contact load between the drive roller and the driven roller to rotate the driven roller with frictional force caused by the contact load, and a spindle connected to at least the driven roller of the drive roller and the driven roller and transmitting rotation of the driven roller to the rolls. A rolling mill uses the rolling mill drive apparatus. A rolling method is for rolling using the rolling mill.

30 Claims, 9 Drawing Sheets

ROLLING MILL DRIVE APPARATUS, ROLLING MILL AND ROLLING METHOD

BACKGROUND OF THE INVENTION

The present invention relates to a rolling mill which is suitable for cold rolling of a thin strip required of high quality such as material for lead frames, shadow masks, etc. and, more particularly, to a drive apparatus for driving rolls of a rolling mill, a rolling mill having the rolling mill drive apparatus and a rolling method.

Rolling mills for rolling a thin plate required of a high quality such as material for lead frames, shadow masks, etc. are used widely in order to roll material to make the thickness thin. The types of rolling mills are a 2-high rolling mill, a 4-high rolling mill and a 6-high rolling mill which rapidly is being widely used in recent years. Further, there are cluster type 12-high or 20-high rolling mills represented by sendzimir mills. Further, usually, it is necessary to drive two rolls in order to supply a power necessary for rolling, it is of course for drive rolls to be work rolls in a 2-high rolling mill, and it is fundamental that drive rolls are work rolls even in a 4-high rolling mill or in a more-than-4-high rolling mill. However, in a case of rolling a hard and thin material, it is necessary to make the diameter of a work roll small, in this case, the driving system becomes weak, so that a backup roll in a case of a 4-high rolling mill or an intermediate roll in a case of a 6-high rolling mill is driven. In a case of a cluster rolling mill, since the work rolls each have a small diameter in general, intermediate rolls (for example, 4 rolls in a case of a 20-high rolling mill) are driven.

Each of those rolls, in general, is connected to a spindle and driven by one electric motor through a gear type pinion stand. A work roll drive system of a 4-high rolling mill, which is a most typical example, is explained, referring to FIG. 14. In FIG. 14, power of an electric motor 100 is transmitted to an upper pinion 102 of a gear type pinion stand 101*a* through a coupling shaft 101. The power drives an upper work roll 106 through an upper spindle 104. On the other hand, the upper pinion 102 transmits the power to a lower pinion 103, the power is transmitted to a lower work roll 107 through a lower spindle 105, thereby to execute rolling. The upper and lower work rolls 106, 107 are supported by upper and lower backup rolls 108, 109, respectively. Here, the gear type pinion stand 101*a* is an important machine serving the role of a distributor for distributing the power from one electric motor 100 to two rolls to drive them.

There is a twin drive system which drives individually two rolls by two electric motors, respectively, which system is different from the drive system driving 2 rolls by one electric motor as mentioned above. This is used in a case of a large-sized rolling mill which employs a backup roll drive system and in a case where a gear type pinion stand is prevented from becoming huge in size. Further, this system may be applied, in some cases, to a work roll drive system in order to attain an advantage that rolling can be effected without managing strictly a difference between work roll diameters even in the work roll drive system. In this case, however, pinion and gears are necessary to secure a space for two electric motors and direct connection between the electric motors and the work rolls is difficult without the pinion and gears.

On the other hand, a conventional roll drive system without using a gear type pinion stand and spindle is disclosed in JP A 55-77916. This system has a construction in which a rolling roll is driven by directly bringing a drive roller into contact with the rolling roll without using the gear type pinion stand and spindle.

The conventional roll drive system which uses the gear type pinion stand and spindle is as mentioned above, and the system has a large number of points to be improved. The description about the points is as follows.

(1) The quality of plate surface:

Material for electronics represented by lead frames for semiconductors, shadow masks, etc. is required to be thinner and to have a higher quality. As for the improvement of the quality, plate thickness and plate shape precision has reached a stage to satisfy the requirements of recent technical developments. However, there are still left cases wherein very fine marks occur on plate surfaces and detract from the quality. There are various causes therefor, and one of which is that a rolling roll drive mechanism has gears. That is, when the gears are used in the driving system of rolling rolls, a driven gear can not attain correct rotational speed because of errors in tooth shape and errors in pitch, and a slight change in speed occurs. This change results in a cause for creating the marks on the plate surfaces. One of other causes is that there is a backlash which always exists in the gears. In a case where a thin plate is rolled with small torque, the driven gears change in speed by increasing or decreasing in the rolling speed because of the backlash, whereby vibrations are induced and marks are generated on the plate surfaces. This is similar to a drive system of a coiler for winding up a plate after rolling. In the coiler, the cause disappears by employing a direct connection system for directly connecting the coiler and an electric motor without using gears. In the rolling roll drive mechanism, also, a direct connection system can be employed by employing a twin drive system in a backup drive system, however, two electric motors are required, and the electric motors each are required to be large in size and low in rotation well enough to be able to drive a large-sized backup roll. Further, two control systems are required for controlling them, and the cost becomes high.

(2) Spindle rupture accident:

Of spindles used mainly for cold rolling apparatus, there are a gear type apparatus and a cross pin type apparatus using a rolling bearing. Recently, the latter has been used more widely because the latter has a higher efficiency and excellent maintenance operation. However, since the cross pin type apparatus is less in strength than the gear type apparatus in a case where plate rupture occurs and an excessive load is applied, it has a weak point that the rolling is caused to come to a rest by occurrence of the rupture accident. Further, in a high speed tandem mill, an excessive torque occurs by squeezing a material at a time of plate rupture, etc., and a spindle of a weak portion, or in some cases such a large accident as a tooth portion of a pinion is broken occurs sometimes. Such an accident, even when a spindle having the same strength is used, occurs very rarely at a rolling mill of front stage in which rolling torque is large, and in most cases, it occurs at a rolling mill of final stage at which torque is smallest. This is concerned with the fact that plate rupture occurs most frequently at the stand at which plate thickness becomes thin. It is difficult to detect correctly an abnormal torque due to the rolling trouble, however, in usual the torque is estimated to reach 800% of the usual maximum torque of an electric motor from the rupture conditions of the driving portion. As a countermeasure for this, in general, it is considered to use a shear pin, however, the shear pin has a ratio between the fatigue limit and the final strength, of about 3:4 and the shear pin may not be a sufficient protection means. Additionally, much time is required for exchanging the shear pin and efficiency is not good.

(3) Roll damage in a case of backup roll or intermediate roll drive system:

In a case of a backup roll drive of a 4-high rolling mill for instance, an excessive load is rapidly applied on work rolls when a rolling trouble such as plate rupture, squeezing, etc. occurs, so that the work rolls can not be rotated with frictional force from the backup rolls, and the work rolls rapidly decelerate and stop. On the other hand, the backup roll directly connected to an electric motor requires a long time until it stops because the backup roll including the electric motor has large inertia, during that time even if a screw-down operation for the work rolls is released, the backup roll continues to rub the work rolls for a relatively long time. As a result, the work rolls are shaved out to be in a half-moon shape, and run into a fatal damage accident, so that in some cases a roll cost may be increased to several times one of a work roll drive system. Therefore, even if a work roll of small diameter is desirable in order to roll a hard and thin material, in some case, the work roll drive system in which the diameter of the work roll is made larger has to be taken in view of the above-mentioned. This is similar to in a case of a 6-high rolling mill.

(4) Difficulty to effect high speed rolling:

Although high speed rolling is necessary to improve the productivity, when plate rupture occurs during the high speed rolling, damages of devices thereof become large and repairing cost increases and further non-operating time increases. Even without such things, much time is required for treating cobbles. Therefore, in rolling of metal plate (very thin material) which is thin and required of high quality such as lead frame material, shadow mask material, etc., in many cases, rolling at a low speed has to be effected without effecting high speed rolling necessary to improve the productivity.

On the other hand, in a conventional roll drive system without using a gear type pinion stand and a spindle, which system is disclosed in JP A 55-77916, since a drive roller is directly contacted with a rolling roll, it is inevitable that a rolling oil adheres between the drive roller and the rolling roll, causing the friction coefficient between the drive roller and the rolling roll to be reduced to a small value and loss occurs in the load applied to the drive roller. Therefore, it is necessary to apply a load of an amount corresponding to a rolling load from the drive roller. The electric motor is required to have very large power, which results in a large-scaled facility which is high in cost. Further, in this case, once the rolling oil is adhered between the drive roller and the rolling roll, it is very difficult to remove it. For example, it is difficult to remove completely the oil without taking such a method as burning it out, and a lot of labor is required.

SUMMARY OF THE INVENTION

An object of the present invention is to provide a rolling mill drive apparatus, a rolling mill and a rolling method, which is able to improve the quality of plate surfaces, prevent a spindle rupture accident and a fatal damage of rolls, increase a rolling speed and decrease the cost.

In order to achieve the object, according to the present invention, a rolling mill drive apparatus for driving any rolls of a pair of work rolls, 2 to 4 intermediate rolls and 2 to 4 backup rolls is provided, which apparatus is characterized by comprising a drive roller rotated by an electric motor, at least one driven roller contacting with the drive roller, a load imparting means for imparting a contact load between the drive roller and the driven roller to rotate the driven roller with frictional force caused by the contact load, and a spindle connected to at least the driven roller of the drive roller and the driven roller and transmitting rotation of the driven roller to the rolls.

In the present invention having the above-mentioned construction, rotational power of the electric motor is transmitted to the rolling roll by using the rollers (the drive and driven rollers) instead of transmission of the rotational power from an electric motor to rolling rolls by using a conventional gear type pinion stand. That is, a contact load is applied between the rollers by the load imparting means, and rotation of the drive roller is transmitted to the driven roller with frictional force caused due to the contact load. The rotation of the roller is transmitted to the rolling roll by the spindle. In this manner, since the contact load is imparted to the roller without teeth (cylinder) and the rotational power (torque) from the electric motor is transmitted, such marks as might be caused by errors in tooth shape, pitch errors, backlash, etc. in the conventional apparatus do not occur on the rolling material surfaces.

Further, in a case where a gear type pinion is used as in a conventional manner, when such a rolling trouble as plate rupture occurs, meshing of gears is disengaged and rotational power is cut off under the condition that load is applied. In such a case, the power is transmitted between tooth tips of the gears, therefore, a danger that teeth may be ruptured occurs. Further, at the time of a rolling trouble, a very severe load is applied even under the usual gear-meshing condition, and it is very dangerous and impossible in practice to alleviate such an abnormal condition by disengaging the gears meshed with each other at this time. On the contrary, since the present invention employs a system in which the rotational power of the electric motor is transmitted to the rolling roll by the rollers, it is possible to rapidly release the contact load between the rollers and extinguish the transmission torque when it is required, whereby a spindle rupture accident and fatal damage of the roll can be prevented. Therefore, it is possible to roll a hard and thin rolling material at a high speed, employing a backup roll or intermediate roll drive system and using a small diameter work roll.

Further, the present invention is to use to its fullest capability the transmission ability of rotational driving power between the rollers with frictional force caused between the rollers on the basis of a contact load, and basically, the operation is not executed under the condition that oil exists between the rollers. Therefore, loss in the load applied to the rollers does not occur as in the prior art disclosed in JP A 55-77916 and it is not required to make the equipment such as an electric motor large in size and high in cost.

In the above-mentioned rolling mill drive apparatus, it is preferable that two driven rollers are provided, the spindle is connected to the two driven rolls, and a contact load interruption means is provided for interrupting, in a moment, the rotation transmitted from the electric motor to the driven rollers via the drive roller and the frictional force caused due to the contact load by extinguishing the contact load from the load imparting means in a moment, according to a demand. Thereby, it is possible to separate the rolling roll from the electric motor side in a moment.

In the above-mentioned apparatus, it is preferable to have a brake means for rapidly decelerating the rotation due to inertia of said drive rollers which became free from the contact load upon interruption of the contact load by said contact load interruption means, whereby it is possible to decelerate or stop the rolling roll separated from the electric motor side and prevent occurrence of cobbles and damage in various devices.

In the above-mentioned apparatus, it is preferable to further provide a plate rupture detection means for detecting occurrence of plate rupture during rolling and operating the contact load interruption means on the basis of the detection result. Further, it is provided with a contact load adjusting means for adjusting the contact load during rolling according to rolling conditions.

Further, in the present invention, it is possible to construct it so that the driven roller is single, the spindle is connected to both of the drive roller and the driven roller, and that the apparatus further comprises a contact load interruption means for interrupting, in a moment, the rotation transmitted from the electric motor to the driven roller via the drive roller and the frictional force caused due to the contact load, by extinguishing the contact load from the load imparting means in a moment, according to a demand, and a brake means for rapidly decelerating the rotation due to inertia of the drive roller which became free from the contact load upon interruption of the contact load by the contact load interruption means.

The material of each of the drive roller and the driven roller is preferable to be the same as that of a high-speed steel roll.

Further, in the present invention, it is possible to further provide a rotational speed difference detecting means for detecting rotational speed of each of the rollers, and an operation control means for calculating a rotational difference between the adjacent rollers, and operating the contact load interruption means when the rotational speed difference reaches a predetermined value or more (for example, 10% or more). With this construction, when a rotational speed difference between the rolls became larger due to occurrence of a rolling trouble, etc., the load between the rolls is released. Therefore, in a case where small diameter work rolls are used and a backup roll or intermediate roll drive system is employed, for instance, it is possible to avoid such a fatal damage as the work rolls are cut off to be a half-moon shape, as mentioned above.

Further, according to the present invention, a rolling mill is provided, in which two roll groups of rolls are accommodated in one rolling mill housing, each of the two roll groups of rolls comprising a pair of work rolls and at least one pair of rolls supporting the pair of work rolls, and the rolling mill is characterized by having the above-mentioned rolling mill drive apparatus mounted on any rolls of the work rolls or the rolls supporting the work rolls of the above-mentioned roll groups.

Further, according to the present invention, a rolling method is provided, using rolls driven by the rolling mill drive apparatus as mentioned above, and characterized by detecting an occurrence of plate rupture during rolling by the plate rupture detecting means or eyes, and operating the contact load interruption means on the basis of the detection result, and a rolling method, characterized by adjusting the contact load adjusting means according to rolling conditions.

Further, according to the present invention, provided is a rolling mill drive apparatus as mentioned above, which is characterized in that the rolling mill drive apparatus comprises three of the driven rollers, first and second driven rollers of which are arranged so as to individually contact with the drive roller, and a third driven roller arranged so as to contact with the second driven roller and not to contact with the drive roller and the first driven roller; the load imparting means is arranged so as to be able to impart independently a contact load between the drive roller and the first driven roller and between the drive roller and the second driven roller; a further load imparting means is provided for imparting a contact load between the second driven roller and the third driven roller, and rotating the third driven roller with frictional force caused due to the contact load; and the spindle is connected to both of the first and third driven rollers.

In this case, it is possible to impart individually a contact load between the first driven roller connected to the spindle and the drive roller (by the load imparting means), and between the third driven roller connected to the spindle and the second driven roller (by the further load imparting means), of three driven rollers and one drive roller. Accordingly, for example, in a case where any rolling trouble occurs such as a coefficient of friction between one of a pair of work rolls and the rolling material becomes abnormally high and stick occurs, since torque applied to the rolls is adjusted individually, there is no possibility that the torque concentrates on one of the rolls, and the concern that an excessive load is inadvertently applied on the spindle disappears. Thereby, it is possible to protect the spindle.

BRIEF DESCRIPTION OF THE DRAWINGS

FIGS. 11A and 11B each are a schematic diagram for explaining a sixth embodiment of the present invention, wherein FIG. 11A is a front view sectioned in part of a rolling mill drive apparatus and FIG. 11B is a side view of FIG. 11A;

DESCRIPTION OF EMBODIMENTS

Figure 1:
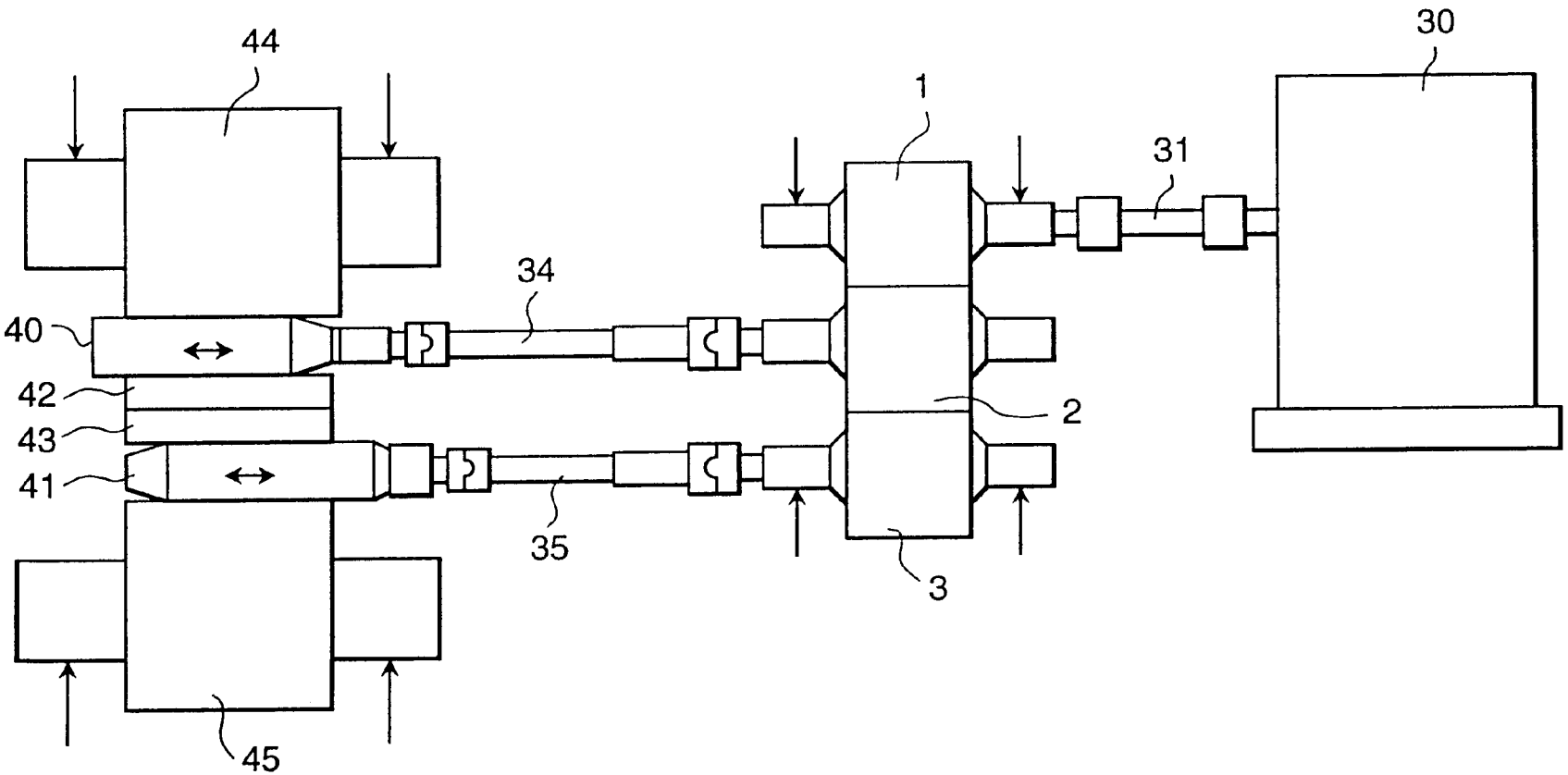
FIG. 1 is a side view of the whole rolling mill having a rolling mill drive apparatus of a first embodiment of the present invention.

A first embodiment of the present invention is explained hereunder, referring to FIG. 1 to FIG. 5. FIG. 1 is a view of the whole rolling mill having a rolling mill drive apparatus of the present embodiment, FIG. 2A is a front view sectioned in part of the rolling mill drive apparatus of the present embodiment and FIG. 2B is a side view of FIG. 2A.

FIG. 1 shows a 6-high rolling mill comprising work rolls 42, 43, intermediate rolls 40, 41 and backup rolls 44, 45. The two intermediate rolls 40, 41 are imparted rotational force by driven rollers 2, 3 through spindles 34, 35, respectively. Rotation of the driven rollers 2, 3 is transmitted by a drive roller 1. That is, a contact load is applied between the rollers 1, 2, 3 as shown by arrows in FIG. 1, the drive roller 1 is driven by an electric motor 30 through a coupling shaft 31, the rotation of the drive roller 1 is transmitted to the driven rollers 2, 3 by frictional force due to the contact load between the rollers 1, 2, 3, whereby the torque is transmitted to the intermediate rolls 40, 41. In FIG. 1, the contact load imparted between the rollers 1, 2, 3 and the rolling load (load for rolling) applied to the intermediate rolls 44, 45 are illustrated by arrows.

Figure 2B:
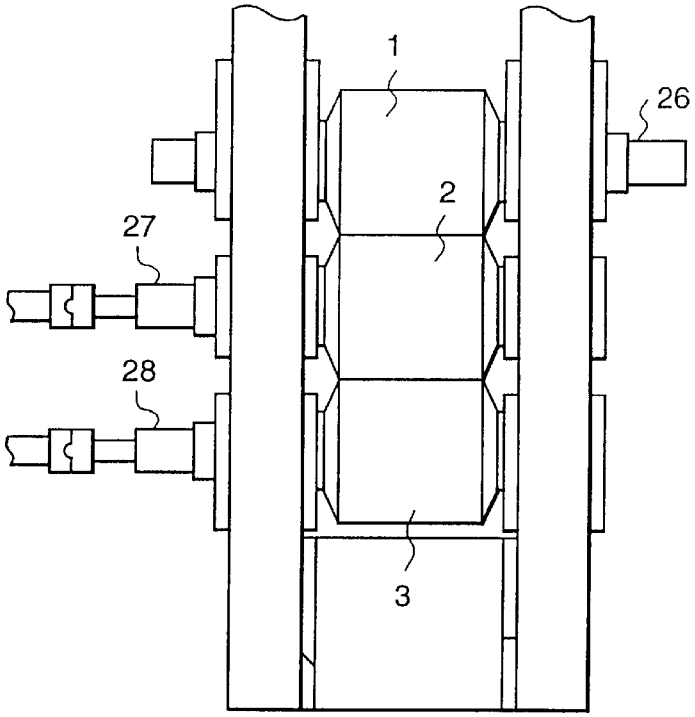
FIG. 2B is a side view of FIG. 2A.
Figure 2A:
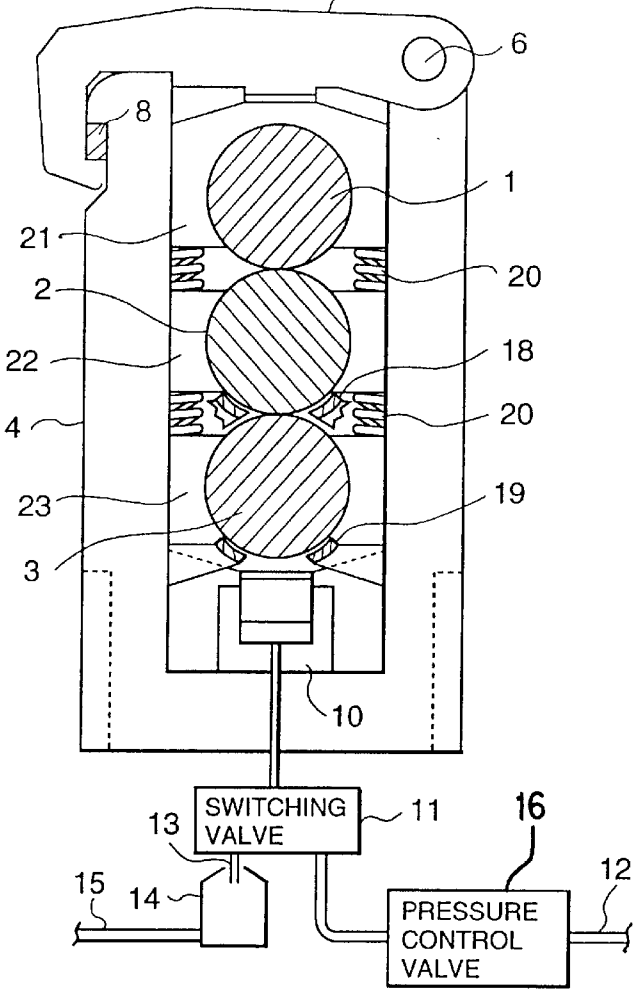
FIG. 2A is a front view sectioned in part of the rolling mill drive apparatus in FIG. 1.

As shown in FIGS. 2A, 2B, the drive roller 1 is connected to the electric motor 30 at a shaft end side 26, and the driven rollers 2, 3 are connected to the spindles 34, 35 at shaft end sides 27, 28, respectively. The rollers 1, 2, 3 are supported by bearing boxes 21, 22, 23 within a frame 4. A lever 5, of which a fulcrum is at a pin 6, is mounted on an upper portion of one side of the frame 4 by the pin 6, and both sides of the upper portion of the frame 4 are connected by the lever 5. A cotter 8 is mounted between a tip portion of the lever 5 and a frame 4. Springs 20 are mounted between the bearing boxes 21, 22, 23, and brakes 18, 19 as brake means are mounted for the driven rollers 2, 3.

A contact load is imparted between the rollers 1, 2, 3 by a hydraulic cylinder 10 as a load imparting means, and the contact load can be adjusted by a pressure control valve 16 as a contact load adjusting means through a switching valve 11. Further, if necessary, it is possible to connect the hydraulic cylinder 10 to a high pressure line 12 or connect the hydraulic cylinder 10 to a pipe line side 13 to rapidly decrease the pressure in the cylinder 10. At this time, an oil tank 14 is provided to reduce the flow resistance of the oil to a small valve and the oil is returned to a return tank (not shown) through a pipe line 15, taking a lot of time. A necessary contact load is applied to the rollers 1, 2, 3 by the hydraulic cylinder 10 during rolling. When the supply of pressurized oil to the hydraulic cylinder 10 is stopped by switching the switching valve 11 according to a demand, the rollers 1, 2, 3 are separated from each other by force of the springs and the contact load disappears. Thereby, at the time as rotational force of the driven rollers 2, 3 disappears, the rollers are brought into contact with the brakes 18, 19, and the rotation of the rollers 2, 3 and the intermediate rolls 40, 41 driven thereby is rapidly stopped by the braking action. In order to rapidly effect such actions, it is desirable to select the switching valve 11 having a high responsibility. Further, in a case where a contact load between the rollers 1, 2, 3 is large, it is possible to employ hydraulic cylinders instead of the springs 20.

Hereunder, the rolling mill drive apparatus of the present embodiment is explained to clear the practicality in turn.

Figure 14:
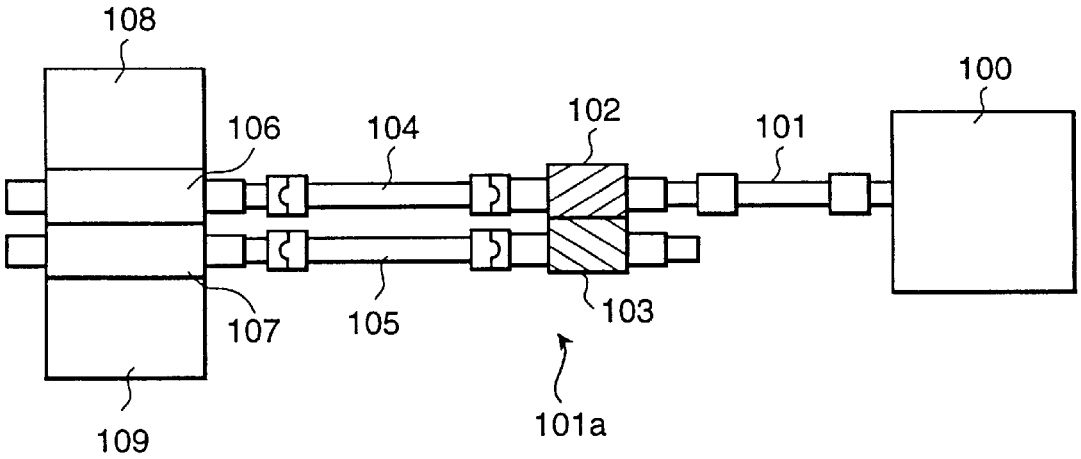
FIG. 14 (PRIOR ART)
FIG. 14 is a side view of a conventional 4-high mill for explaining a work roll drive system of the mill.

First of all, in the conventional drive system as explained in FIG. 14, the rotational speed of the rolling roll precisely meets with that of the electric motor if errors in the gears are ignored. On the contrary, in the present embodiment, it is considered inevitable that a slight delay occurs in the rolling roll, but it is no problem in practice that the rotational speed of the electric motor does not correctly accord with that of the rolling roll. This is explained hereunder.

Figure 3:
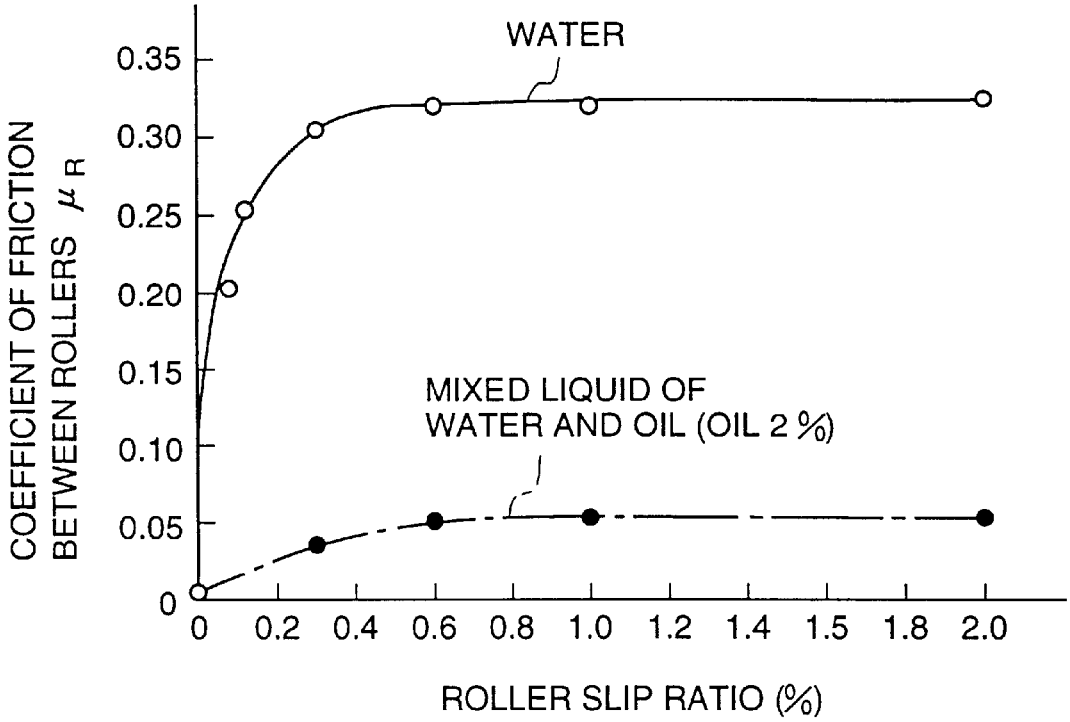
FIG. 3 is a graph showing an example of measurement of coefficient of friction between the rolls as shown in FIG. 2A, 2B.

FIG. 3 shows measured coefficient of friction between the rollers. When the rollers are rotating, a coefficient of friction $\mu_R$ is determined according to a slip ratio between a driven roller and a drive roller. The slip ratio S is a value as defined by the following equation:

$$S=(V_D-V_f)/V_D\times 100\ (\%) \qquad 1$$

where rotational peripheral speed of the drive roller is VD and a rotational peripheral speed of the driven roller is $V_f$.

In FIG. 3, a case where water is supplied between rollers and a case where a mixture of water and oil 2% is supplied for reference are shown. The mixture of the latter is a kind of roll coolant, used for lubrication and cooling, between a rolling material and rolling rolls during cold rolling. The coefficient of friction $\mu_R$ rapidly increases and reaches a constant value by a slight increase in slip between the rollers, however, the coefficient of the friction approaches to 0.3 in a case of water and in a case of the mixture, about 0.05 which is very small as compared with the water. If the coefficient of friction $\mu_R$ of 0.25 is applied, the peripheral speed of the roller 2 is delayed by about 0.1%, compared with the rotational speed of the roller 1. As for the roller 3, since torque transmission thereby is sufficient by a half, the coefficient of friction $\mu_R$ also is sufficient by 0.124 which is a half of that between the rollers 1 and 2, and the delay in the peripheral speed of the roller 3 to the roller 2 is 0.05% or less. Further, in a case where nothing is supplied between the rollers (the dry condition), the coefficient of friction $\mu_R$ is substantially the same as or slightly less that a curve of the coefficient of friction $\mu_R$ in a case where water is supplied between the rollers in FIG. 3.

Considering the above, the problem that the rotational speed of the electric motor 30 does not correctly accord with that of the work rolls 40, 41 is not completely a bar to practice. Because although cold rolling is effected in many cases by the backup roll drive system or the intermediate roll drive system, in this case, oil exists between the rolls, and the work rolls are reduced in rotational speed by about 0.2–0.3%, which is not a bar to practice. Therefore, comparing with this, the above-mentioned delay of about 0.1–0.05% in rotational speed of rolls is no problem.

Second, it is considered that rolling torque difference occurs between the rollers according to the peripheral speed difference of the work rolls due to a speed difference. However, this is not a bar to practice. This is explained hereunder.

Figure 4:
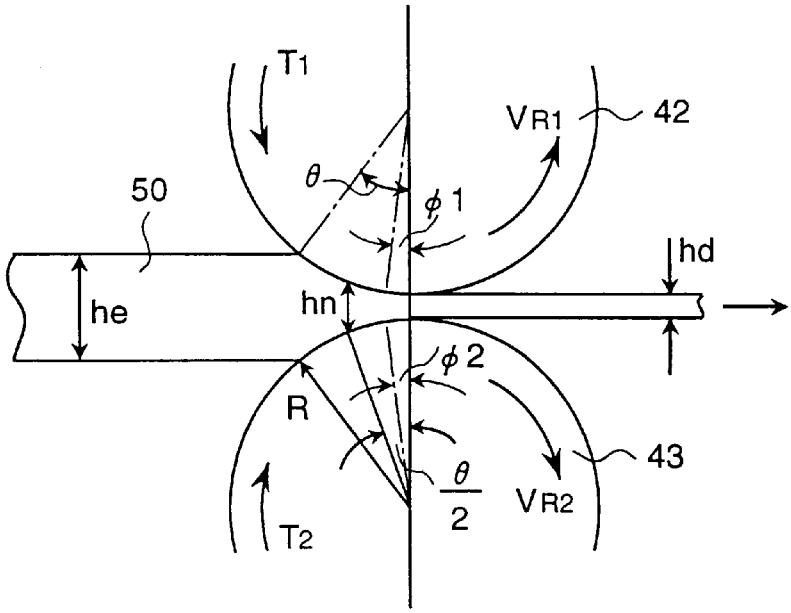
FIG. 4 is a view for explaining the condition under which difference in rolling torque of the working roll is caused by delay in rotational speed between the rollers.

In the above-mentioned example, the rotational speed of the driven roller 3 is delayed by 0.05% or less compared with that of the driven roller 2. Thereby, the rotational speed of the work rolls 42, 43 also is delayed and, in general, a rolling torque difference occurs, which condition is shown in FIG. 4. In FIG. 4, in a case where peripheral speed $V_{R1}$, and $V_{R2}$ of the upper and lower work rolls 42, 43 are completely equal to each other, upper and lower angles (neutral angle) at the points at which no slip occurs between the work rolls and the rolling material 50 are the same as each other, and $\phi_1=\phi_2$. In this case, torque $T_1$ and torque $T_2$ applied to the upper and lower work rolls are the same as each other. Assuming that the torque $T_1$ and torque $T_2$ are 100 in total, respective shares of the torque are 50 and 50 (50:50).

Here, if the lower work roll 43 is not driven, torque sharing is 100:0 and as for the lower work roll 43, the neutral angle is shifted to a position at which torque is not applied from the rolling material 50 to the lower work roll 43. That is, the neutral angle increases from $\phi_2$ to $\theta/2$. Instead, the upper work roll 42 is made the angle $\phi_1$ small to increase the frictional force that the work roll imparts the rolling material. A rotational peripheral speed difference between the upper and lower work rolls 42, 43, calculated in this case is a rotational peripheral speed difference between the upper and lower work rolls 42, 43 in a case where a torque ratio between the upper and lower rolls is 100:0. At this time, the following equation is established from continuity of the plate;

$$V_{R1}\cdot h_d=V_{R2}\cdot h_n \quad 2$$

further, the following equation is established;

$$h_n=h_d+(\theta/2)^2R_1=h_d+\Delta h/4\ (\Delta h=h_e-h_d) \quad 3$$

the peripheral speed $V_{R1}$ of the upper work roll 42 accords approximately with an outlet plate speed of the rolling plate with thickness $h_d$ at an outlet side, the peripheral speed $V_{R2}$ of the lower work roll 43 accord with the speed of the rolling plate with thickness $h_n$ at the neutral point of the lower work roll 43, that is, at the position of the neutral angle $\theta/2$. Thereby, the following equation is established:

$$\frac{V_{R2}}{V_{R1}}=\frac{h_d}{h_n}=\frac{h_d}{h_d+\frac{\Delta h}{4}}=\frac{1}{1+\frac{\Delta h}{4h_d}}=\frac{1}{1+\frac{\Delta h}{4(h_e-\Delta h)}} \quad 4$$

$$=\frac{1}{1+\frac{\gamma}{4(1-\gamma)}}=\frac{4(1-\gamma)}{4-3\gamma}$$

wherein $h_e$ is entrance side plate thickness, and $\gamma=\Delta h/h_e$.

Therefore, a roll slip ratio S is expressed as follows:

$$S=(V_{R1}-V_{R2})/V_{R1}=1-V_{R2}/V_{R1}=1-4(1-\gamma)/(4-3\gamma)=\gamma/(4-3\gamma) \quad 5$$

Slip ratios S of the lower work roll in a case where a torque ratio between the upper and lower torques is 100:0, that is, in the same case as one roll is driven, are obtained according to a reduction ratio $\gamma$, using the above relation. The result is as in a table 1.

TABLE 1

| Y (%) | S (%) |
|---|---|
| 5 | 1.3 |
| 10 | 2.7 |
| 20 | 5.9 |
| 30 | 9.7 |
| 40 | 14.3 |
| 50 | 20 |

Figure 5:
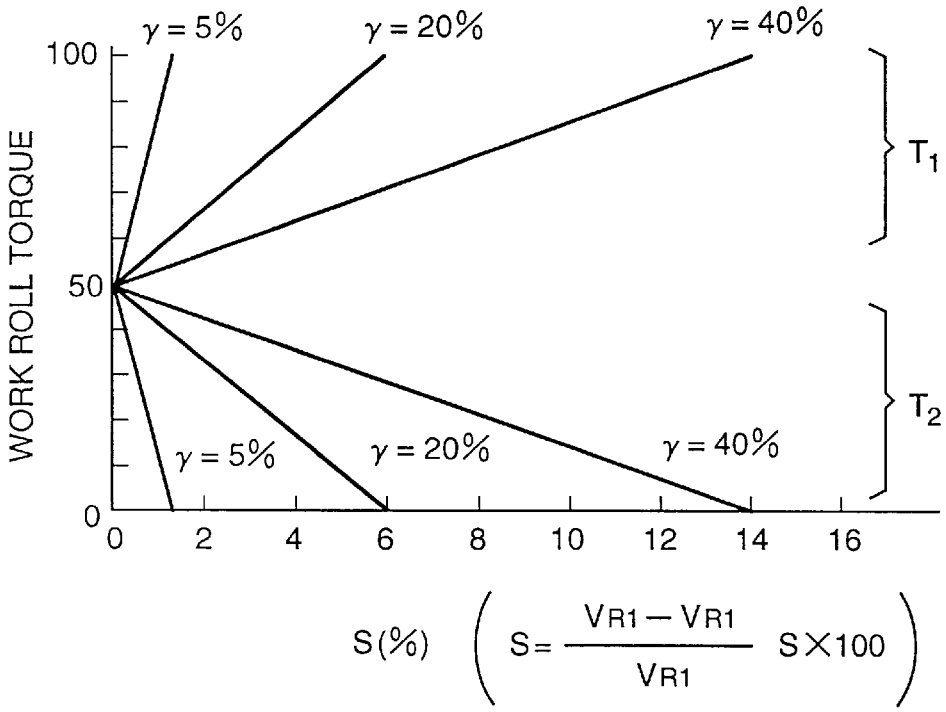
FIG. 5 is a graphical view showing relations between a peripheral speed difference S of upper and lower work rolls and torque of the upper and lower work rolls, with parameter $\gamma$, by expanding relations in the table 1.

In this case, when S=0, both of the upper work roll torque $T_1$ and lower work roll torque $T_2$ are 50 (that is 50:50), a torque difference occurs proportionally as the slip ratio S increases and the peripheral speed increases at upper and lower rolls. FIG. 5 shows calculated results of relations between the peripheral speed difference S of the upper and lower work rolls and torque $T_1$ and $T_2$ of the upper and lower work rolls, with T as parameter, expanding the relation of the table 1.

According to FIG. 5, at a reduction ratio at which usual cold rolling is carried out, that is, in a range of $\gamma$ of 20% or more, even if a roll peripheral speed difference occurs by about 0.2–0.3% according to the peripheral speed difference between the roller 2, 3, a torque difference on the basis thereof is very slight. And even if rotational speed of the driven roller 3 is delayed by about 0.05%, compared with that of the driven roller 2 as in the above example, an influence of the rotational speed difference on the torque difference can be ignored.

Next, in the rolling mill drive apparatus of the present embodiment, in connection with what extent of contact load should be applied between the rollers to transmit rolling power by frictional force, it is tried to calculate approximate values on the basis of practical values. As an example of rolling schedule, a rolling material of soft ion steel plate is taken in which carbon content is 0.08%, the plate thickness is 2 mm, plate width is 1200 mm, and the rolling material is rolled five passes, each pass reduces it at a reduction ratio of 40%.

The power N necessary to roll is expressed as follows by a rolling theory:

$$N=B\cdot S_a\cdot I_n 1/(1-\gamma)\cdot h_d\cdot V_d/\eta f \quad 6$$

where B is plate width, $S_a$ is average deformation resistance of the material, $\gamma$ is a reduction ratio, $h_d$ is plate thickness, $V_d$ is rolling speed and $\eta_f$ is efficiency followed by a frictional loss between the roll and the material. Assuming that the power N is applied on the periphery of the work roll by tangential force F, the tangential force F is given in total of the upper and lower work rolls, as follows:

$$F=N/V_d=B\cdot S_a\cdot I_n 1/(1-\gamma)\cdot h_d/\eta_f \quad 7$$

The result of F which is obtained for each pass of rolling on the basis of the above equation is listed in a table 2. Although a value of $\eta_f$ changes variously according to work roll diameter and kinds of roll coolant, it is about 0.8. In the table 2, values are calculated assuming that $\eta_f$ is constant 0.8 for each pass.

TABLE 2

| Rolling pass | 1 | 2 | 3 | 4 | 5 |
|---|---|---|---|---|---|
| Thickness (mm) | 2 → 1.2 | 0.72 | 0.43 | 0.26 | 0.16 |
| Reduction ratio (%) | 40 | 40 | 40 | 40 | 40 |
| $S_a$ (kg/mm$^2$) | 58 | 68.8 | 80.8 | 87.6 | 92 |
| F (ton f) | 53.4 | 38 | 27 | 17.5 | 11 |

Assuming that the above drive is used for work roll drive, for example, and the work roll is driven by the rolling mill drive apparatus of the present embodiment, the roller 1 is necessary to transmit force corresponding to F of the table 2 to the roller 2, and the roller 2 is necessary to directly transmit torque to the rolling roll and also the same torque to the roller 3. Assuming that a contact load between the rollers is Q, frictional coefficient between the roller is $\mu_R$, work roll diameter is $D_w$ and the diameter of rollers 2, 3 is $D_R$, the contact load Q can be obtained from equation 8 or 9.

$$\mu_R\cdot Q\cdot D_R \geqq F\cdot D_w \quad 8$$

$$Q \geqq F/\mu_R\cdot D_w/D_R \quad 9$$

In general, $D_R$ becomes about 1.25 times $D_w$ according to an inclination angle of the spindle, whereby $D_w/D_R=1/1.25=0.8$. Taking into consideration acceleration, deceleration and safety, and taking $\mu_R$ to be 0.22 from FIG. 3, a necessary contact load Q corresponding to each value of F in the table 2 is obtained as in a table 3.

TABLE 3

| Rolling pass | 1 | 2 | 3 | 4 | 5 |
|---|---|---|---|---|---|
| F (ton f) | 53.4 | 38 | 27 | 17.5 | 11 |
| Q (ton f) | 194 | 138 | 98 | 64 | 40 |

In this case, assuming that the nominal diameter (maximum diameter) is 400 mm, the diameter of the roller 2, 3 can be 500 mm, the rollers can bear sufficiently a load of 200 ton f.

For example, when normal rolling is being performed under the condition of the coefficient of friction $\mu_R$=0.22, even if a rolling trouble occurs, an excessive torque occurs, a rapid relief is not in time and the coefficient of friction $\mu_R$ increases to 0.35 at maximum, the coefficient of friction $\mu_R$ can be up to 1.6 times the value in the normal operation. A ratio between the final strength and fatigue strength of a usual cross pin is about 1.8 in a one way rolling and about 2.5 in case of reversible rolling. Since the fatigue strength of the spindle is set to a higher value than force usually applied during rolling, even if a rolling trouble occurs, only force of at most 1.6 times the value during normal rolling is applied and the danger of spindle rupture decreases. Therefore, since it is possible to construct so that an excessive force is not applied onto the spindle, it is possible to use work rolls of smaller diameter. In a reversible rolling mill, it is desirable to extend the life of the rollers or roller bearings by changing the load Q in the table 3 in each pass, and in a tandem rolling mill, it is particularly effective to apply the rolling mill drive apparatus of the present embodiment into a rolling mill of final stage at which many plate rupture accidents occur.

The above estimation of contact load is considered about only the case of work roll drive in order to make it simple to explain. However, in a system of driving the intermediate rolls 40, 41 of the 6-high rolling mill shown in FIG. 1, since it is possible to make the diameter of the driven rollers 2, 3 larger, compared with the diameter of the intermediate rolls 40, 41, the contact load Q can be further smaller, and the condition therefor can be moderated further. Further, it also is possible to drive the backup rolls 44, 45.

According to the above-mentioned embodiment, the rotational power (torque) of the electric motor 30 is transmitted to the rollers 1, 2, 3 having no teeth formed thereon, without using a conventional gear type pinion stand, so that marks due to causes of tooth shape errors, pitch errors, backlash, etc. as in the conventional apparatus are not generated on the rolling material surfaces. Therefore, the quality of rolling material surfaces can be raised.

Further, the contact load between the rollers 1, 2, 3 is released by action of the switching valve 11 according to a demand to extinguish the transmission torque, and the rollers 2, 3 are braked after releasing the contact load by the brakes 18, 19, so that it is possible to separate the rolling rolls from the electric motor 30 in a moment, to suppress occurrence of cobbles and damages of various devices or apparatus and prevent a fatal damage such as rupture accident of the spindles 34, 35 and cutting off in a half-moon shape of the work rolls 42, 43. Further, since the apparatus is a construction which uses a transmission ability of rotational power from the drive roller 1 to the roller 2 and from the roller 2 to the roller 3 with frictional force caused between the rollers 1, 2, 3 by a contact load, and it is not operated under the condition that oil exists between the rollers 1, 2, 3, loss does not occur in the contact load applied between the rollers 1, 2, 3, equipment such as electric motor, etc. is not made large-scaled and the cost is not made higher either.

Figure 6:
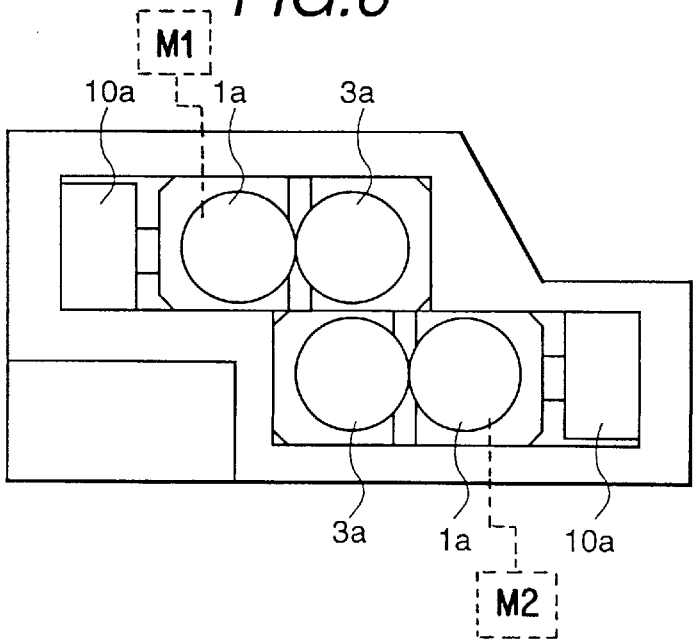
FIG. 6 is a schematic diagram for explaining a second embodiment of the present invention.
Figure 7:
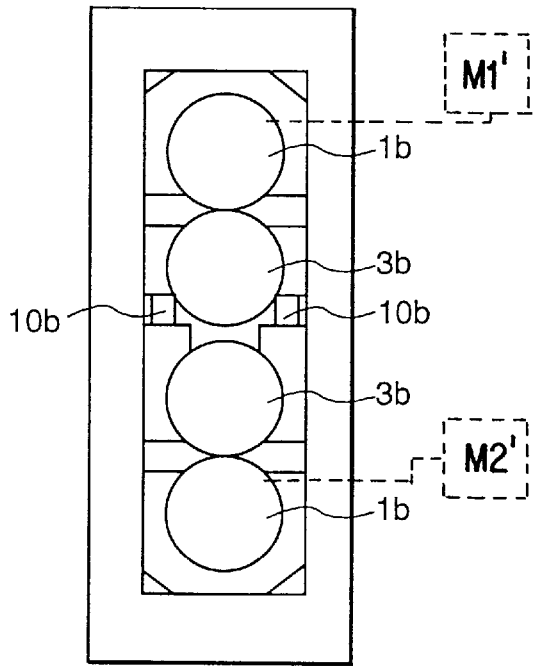
FIG. 7 is a schematic diagram for explaining a third embodiment of the present invention.

Next, second and third embodiments of the present invention are explained, referring to FIGS. 6 and 7, respectively.

FIGS. 1 and 2 show a system in which the rollers 2, 3, and consecutively the upper and lower rolling rolls are driven by one electric motor 30, that is, a system in which the rollers 2, 3 are mechanically constrained to operate, however, it is possible to apply the present invention to a system, called as a twin drive system, in which upper and lower rollers are driven independently by different electric motors, respectively. FIGS. 6 and 7 each show an embodiment in which the rolling mill drive apparatus of the present invention is applied to such a system. In FIGS. 6 and 7, a driven roller 3*a* and a driven roller 3*b* are connected to upper and lower rolling rolls, respectively, and held at positions at which they are not contacted with each other at upper and lower positions. Rollers 1*a*, 1*b* are connected to electric motors, schematically shown at M1, M1', M2, M2' in FIGS. 6 and 7. Hydraulic cylinders 10*a*, 10*b* each impart a contact load for causing frictional force between the drive roller 1*a*, 1*b* and the driven rollers 3*a*, 3*b*. The twin drive system as in the present embodiments is high in cost, however it is advantageous in that it is not necessary to strictly manage a diameter difference between two rolling rolls driven by the driven rollers 3*a*, 3*b*.

Figure 8:
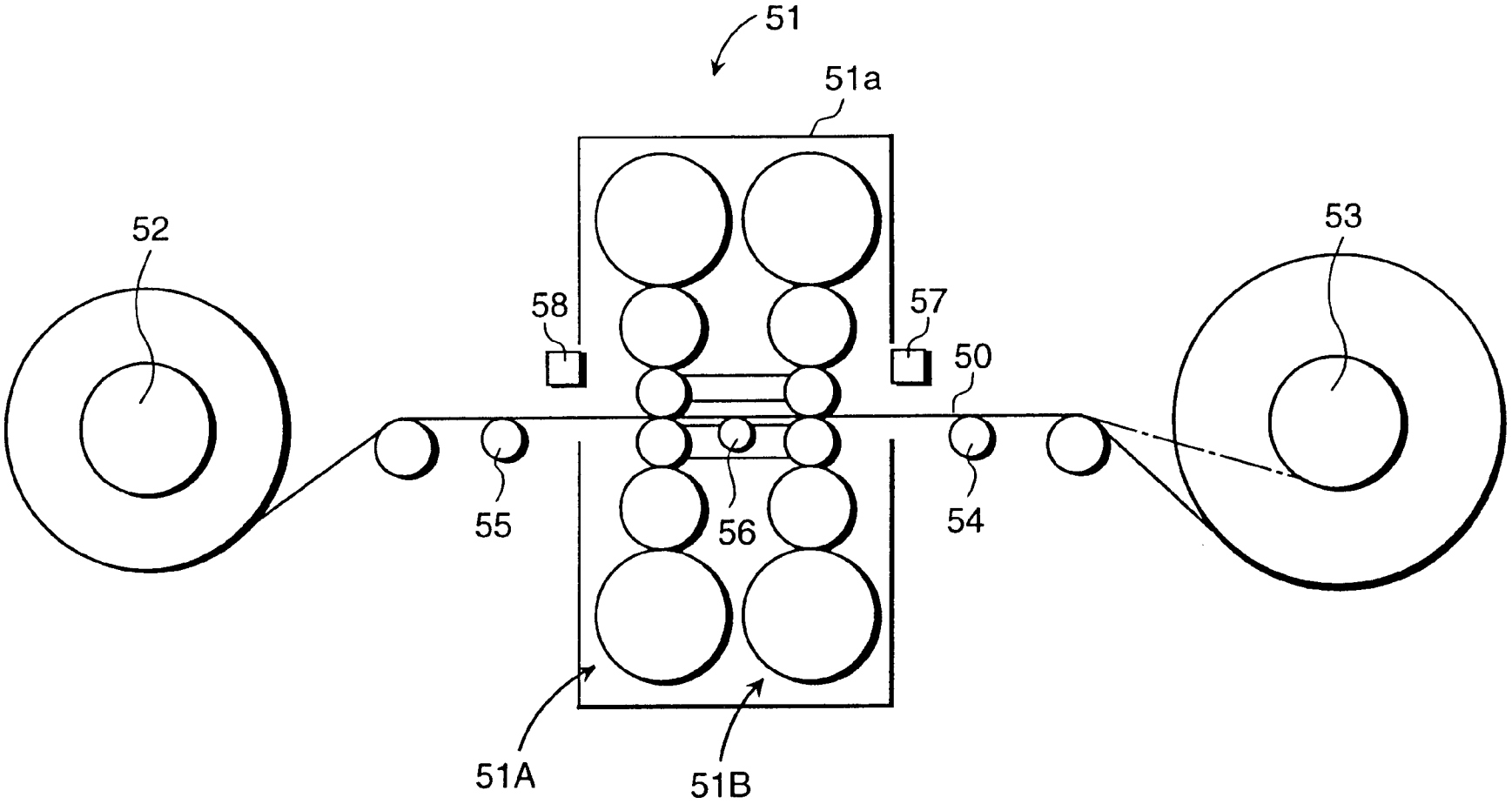
FIG. 8 is a schematic diagram for explaining a fourth embodiment of the present invention and showing a twin mill.

Next, a forth embodiment of the present invention is explained, referring to FIG. 8.

At present, there are a cold tandem mill and a reversible mill as main cold rolling systems. The former is a type in which one pass of rolling reduces material to a desired thickness, and it is a mass production type. The number of stands is 5–6 in a conventional 4-high rolling mill, and 4–5 in a recent high-performance 6-high rolling mill. A production amount changes according to kinds of products, and it is about 1,200,000 tons a year. The latter reduces material to a desired thickness through reversible rolling at one stand. A production amount is about 300,000 tons a year. On the contrary, at present there is not a rolling system satisfying the demand of an intermediate production amount between the above two rolling systems. Further, there has been a desire to provide a reversible mill effecting reversible rolling between two stands, such a mill takes 4–5 m as a distance between the stands, and has a large disadvantage such as yield rate decreases by that extent, so that it has not been put into practice. Instead of those systems, a new system has been proposed, which has an abbreviation called as a twin mill and which accommodates two sets of roll groups in one rolling mill housing. However, the twin mill had only one problem left thereto in which if plate rupture occurs at a central portion of the twin mill during cold rolling, particularly, cold rolling of a thin plate of high quality, cobbles are pushed in and a lot of labor and time is taken and the productivity is greatly reduced. The present embodiment has the rolling mill drive apparatus of the first embodiment applied to the above-mentioned twin mill.

FIG. 8 shows a twin mill of the present embodiment. In FIG. 8, the twin mill 51 has two sets of 6-high roll groups 51 A, 51*b* each accommodated in one rolling mill housing 51*a*. A rolling material 50 is decoiled from a decoiler 52, rolled by the 6-high roll groups 51A, 51B of the twin mill 51 and coiled by a coiler 53. Tension of the rolling material 50 is detected at an inlet side of the twin mill 51, between the 6-high roll groups 51A and 51B and at an outlet side of the twin mill 51 by tension meter rollers 54, 55, 56, respectively. Thickness gauges 57, 58 provided at the inlet and outlet sides of the twin mill 51 detect the thickness of the rolling material 50. With this construction, even if plate rupture occurs anywhere, the tension in the tension meters 54, 55, 56 becomes zero, whereby the plate rupture can be detected. On the basis of the detection result of the tension meters 54, 55, 56, the switching valve is changed over by the same system as explained in FIG. 2A to release the contact load between the rollers in a moment.

In a case of occurrence of plate rupture, it has been practiced by plate rupture detection as mentioned above to rapidly stop an electric motor as a power source of the rolling rolls and to release screw-down force. However, it is not sufficient. In this embodiment, since in addition to the plate rupture detection by the tension meter rollers 54, 55, 56 as mentioned above, it is possible to rapidly release load between the rollers as mentioned above by mounting the rolling mill drive apparatus as shown in the first embodiment on the rolling rolls, it is possible to prevent the above-mentioned disadvantage such that cobbles are squeezed in the inside of the twin mill, and contribute to improvement of the cold rolling systems. In this embodiment, also, the same switching valve as in FIG. 2A is provided for releasing the load between the rollers, in this case, it is desirable to select a switching valve of high responsibility.

In the conventional system using a gear type pinion stand, damage or wear of the gear teeth determines the life of the system except that the gear is abnormally damaged. In such a gear type pinion stand, the tooth faces are hardened, and the tooth faces slip from each other. The tooth faces have sufficient wear resistance by suitably supplying lubrication oil and one can use them for a long time. On the contrary, in the present embodiment, it is unnecessary and impossible to lubricate between the rollers because it decreases greatly the coefficient of friction as shown in FIG. 3. However, wear between the rollers is not always zero, therefore, such rollers that have a high wear resistance and can bear sufficiently the contact load, are desirable.

For those reasons, material for the rollers used in the present embodiment is preferable to be the same material as that of a high speed steel roll of very excellent wear resistance which is used recently as a work roll for hot strip rolling. In a case where the above-mentioned high speed steel rolls are used for the work rolls, it is known that roughness of the roll surface is difficult to change even if slip of the work roll occurs on the rolling material. In a case where the above-mentioned high speed steel rolls are used for the rollers in the present embodiment, it can be expected that the coefficient of friction is kept stable. However, it also is necessary to consider grinding when necessary. In this case, in FIG. 2, for example, the grinding is effected by pulling out the cotter 8, rotating the lever 5 around the pin 6 and then taking out the rollers 1, 2, 3.

According to the above-mentioned embodiment of the present invention, since it is possible to rapidly release the load between the rollers, the above-mentioned disadvantage such as cobbles being pressed in the inside of the twin mill can be prevented, and it is possible to contribute to an improvement of cold rolling systems. Further, without detecting plate rupture by the tension meters 54, 55, 56, it is possible to detect the plate rupture by eyes of an operator and release rapidly the rolling load.

Figure 9:
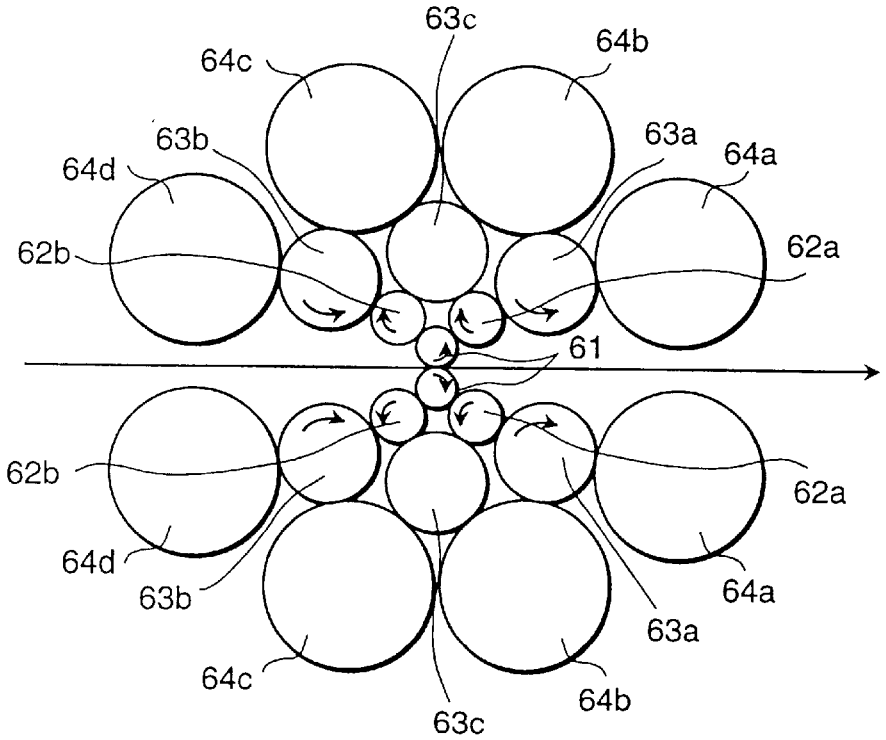
FIG. 9 is a schematic diagram for explaining a fifth embodiment of the present invention and showing a roll arrangement of a 20-high cluster mill.
Figure 10:
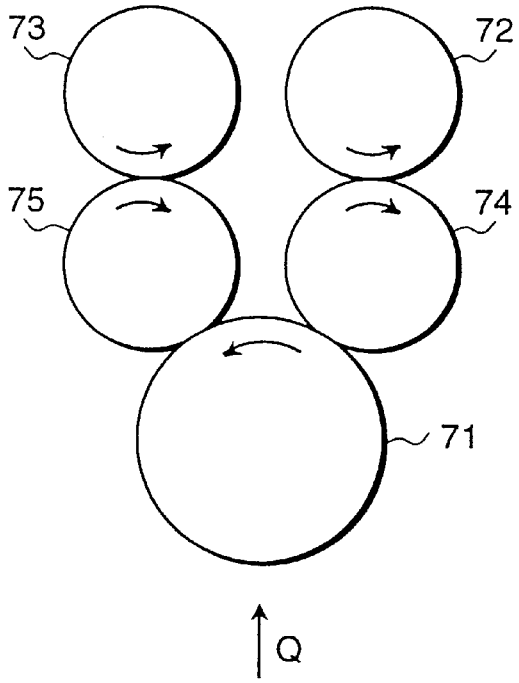
FIG. 10 is a view showing a roll arrangement of a rolling mill drive apparatus for driving total 4 rolls of the second intermediate rolls 63*a*, 63*b* in FIG. 9.

Next, a fifth embodiment of the present invention is explained, referring to FIGS. 9 and 10.

In the first to fourth embodiments, the following case is explained in which rolls of the rolling mill are arranged vertically, rolling mill roll drive apparatus has two rollers for driving the rolling rolls. However, it is necessary to drive four intermediate rolls in a 12-high or 20-high type cluster mill. In the present embodiment, the rolling mill drive apparatus according to the present invention is applied to a 20-high mill which is a typical cluster mill.

The roll arrangement of the 20-high cluster mill is as shown in FIG. 9. In the roll arrangement, work rolls 61 are driven by three second intermediate rolls 63*a*, 63*b*, 63*c* through two first intermediate rolls 62*a*, 62*b*. The second intermediate rolls 63*a*, 63*b*, 63*c* are supported by four rolls 64*a*, 64*b*, 64*c*, 64*d*, called as backup rolls. Upper and lower roll arrangements are symmetrical. The upper and lower second intermediate rolls 63*a* and 63*b* (4 rolls in total) of those rolls are driven by electric motors.

FIG. 10 shows a roller arrangement of a rolling mill drive apparatus for driving a total of 4 upper and lower second intermediate rolls 63*a*, 63*b*. In FIG. 10, a roller 71 which is a drive roller is pressed, with force Q, on rollers 74, 75 which are driven rollers, and rollers 72, 73 contacting with the rollers 74, 75 are pressed with components of the force Q. The drive roller 71 is driven by an electric motor (not shown, but similar to one in FIG. 1), and the rollers 72, 73, 74, 75 are connected to the upper intermediate rolls 63*a*, 63*b* and the lower intermediate rolls 63*a*, 63*b*, in FIG. 9, respectively, through spindles. Basic construction, function, operation method other than the above-mentioned ones are similar to those of the previous embodiments, and the present embodiment also can attain similar effects to them.

Figure 11B:
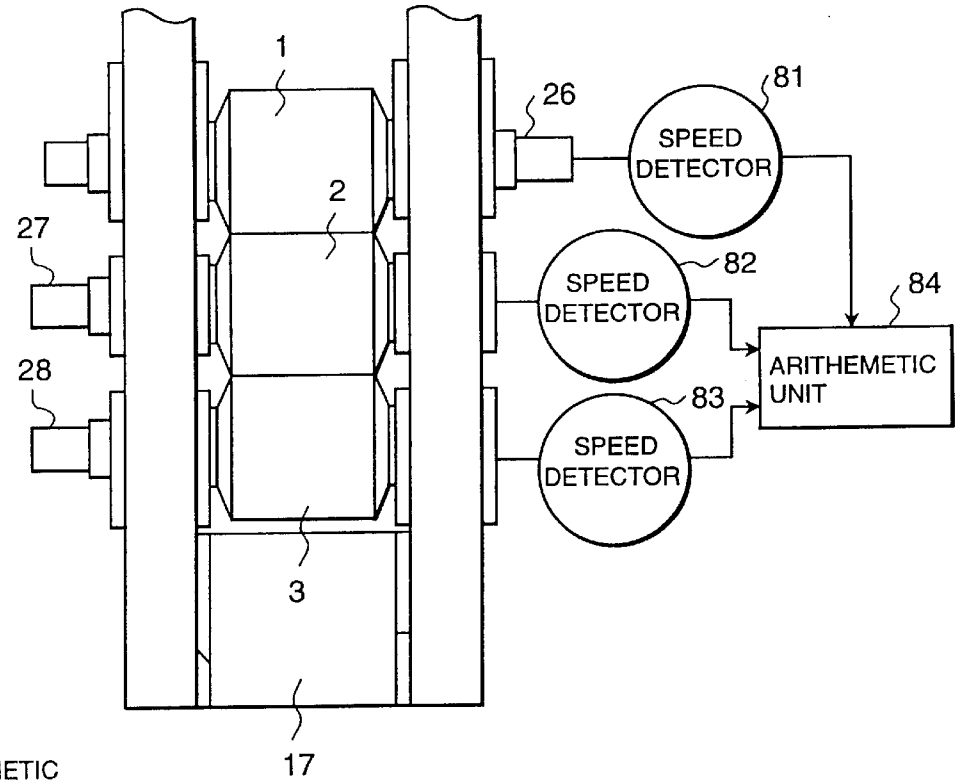
Figure 11A:
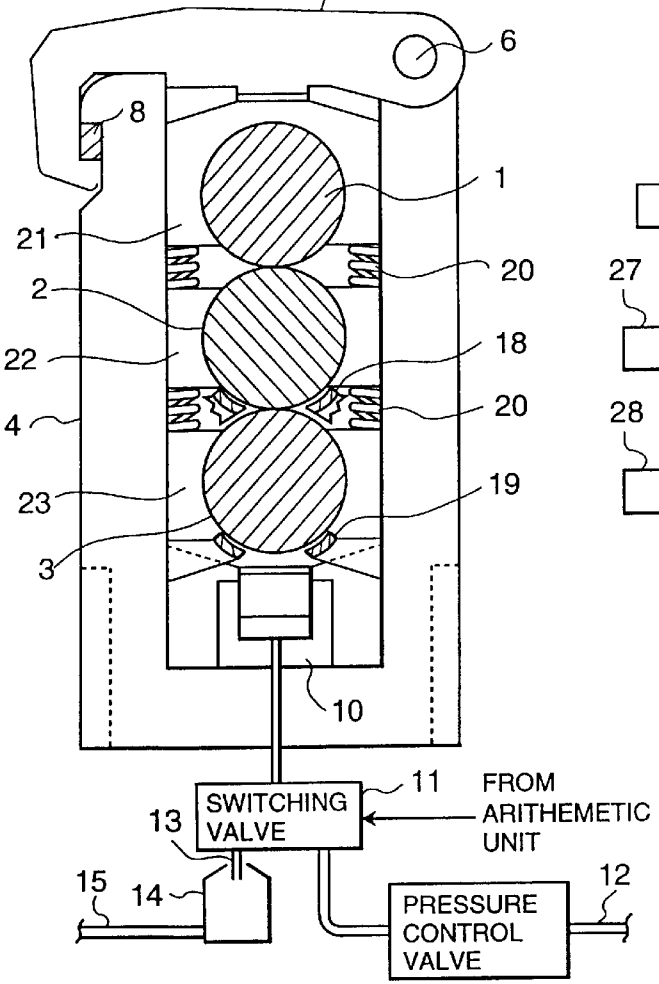

Next, a sixth embodiment of the present invention is explained, referring to FIG. 11. FIG. 11A is a front view sectioned in part of a rolling mill drive apparatus of the present embodiment, and FIG. 11B is a side view of FIG. 11A.

In the present embodiment, speed detectors 81, 82, 83 are mounted on rollers 1, 2, 3, respectively, to detect speed of each roller. Each speed is processed in an arithmetic unit 84 to calculate speed differences between adjacent rollers, that is, between the roller 1 and the roller 2 and between the roller 2 and the roller 3. When the calculation result of speed differences becomes a prescribed value, for example, 10% or more, an instruction is sent from the arithmetic unit 84 to a switching valve 11 to switch the switching valve 11, thereby to stop supply of pressurized oil to a hydraulic cylinder 10, separate the rollers 1, 2, 3 from each other with the force of springs 20 and release a contact load in a moment. Further, the rollers 2, 3 are stopped rapidly by braking action of brakes 18, 19 at the same time as extinguishing of rotation of the rollers 2, 3. The construction and function other than those operations are similar to that in the first embodiment. In FIG. 11, the equivalent elements to those in FIGS. 2A, 2B are given the same reference numbers.

According to the present embodiment, in a case where rotational speed difference between the rollers 1, 2, 3 becomes large due to occurrence of a rolling trouble, etc., the load between the rollers 1, 2, 3 can be released in a moment, so that it can be prevented from suffering from fatal damage such as the work rolls are cut off in a half-moon shape at a time the rolling trouble occurs in a case where a backup roll or intermediate roll drive system is taken, using work rolls of small diameter.

Figure 12:
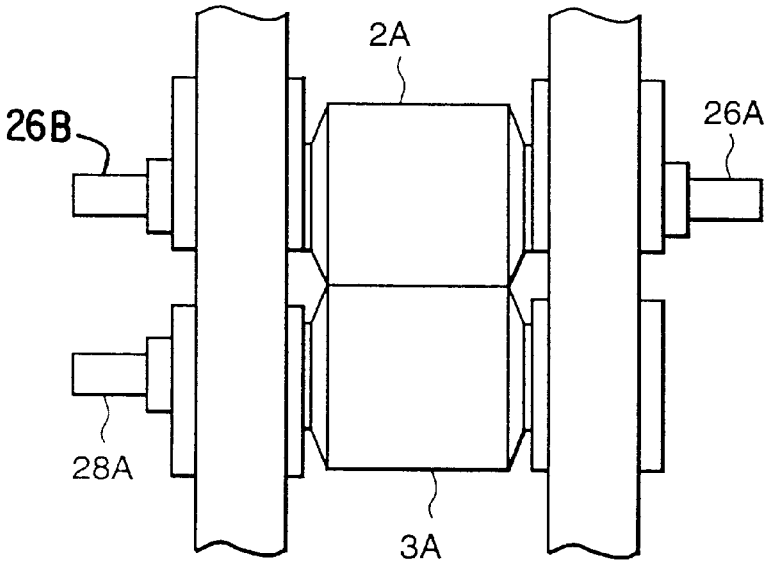
FIG. 12 is a schematic diagram for explaining a seventh embodiment of the present invention.

Next, a seventh embodiment of the present invention is explained, referring to FIG. 12.

In this present embodiment, a roller performing the function of the roller 1 in FIG. 2 is not used, and rolling rolls are directly connected to a roller 2A which is a drive roller via a spindle. That is, in FIG. 12, the drive roller 2A is connected to an electric motor at a shaft end side 26A and to a spindle at other shaft end side 26B. A roller 3A which is a driven roller is connected to another spindle at a shaft end side 28A. Other constructions and functions other than those are similar to those of the first embodiment. In this case, transmission of rotational power from the roller 2A to the roller 3A by frictional force between the roller 2A and the roller 3A becomes only transmission from the drive roller to one roller, a contact load (Q) becomes theoretically a half of that in the first embodiment, which half load is sufficient, and it is possible for the cost to become lower.

With the system of this embodiment, when rapid opening between the rollers is effected, the roller 3A at the lower side stops rapidly, however, the roller 2A at the upper side can not rapidly stop because it is not separated from inertia of the electric motor. However, an ability that the work rolls bite the rolling material in a case where one roller drive as in the present embodiment is reduced to ¼ as compared with in the case of drive by two rollers as in the first embodiment, by rolling theory and an experiment, so that slip occurs between the rolling material and the work roll of which the rotation does not stop and it is impossible to continue the rolling. Additionally, it does not have the ability that the thickness of a portion of the rolling material, formed in cobble becomes twice the thickness of the material itself, and such portion is bitten to generate to a large torque. Therefore, an excessive load applied to the spindle can be decreased greatly.

The present embodiment is desirable to apply in a case where the thickness of rolling material is thick and rolling speed is low, that is, to a rolling mill of front stage of a cold tandem mill. For example, in a case where rolling is effected by a cold tandem mill of five stands according to the rolling schedules as in the table 1 and the table 2, a contact load (Q) between the rollers becomes about 100 ton f by employing the rolling mill drive apparatus having 2 rollers as in the present embodiment in first and second stands, and the rolling mill drive apparatus having three rollers as in the first embodiment in third and fourth stands, and it is possible to reduce the diameter of the work rolls to a further small valve.

Figure 13:
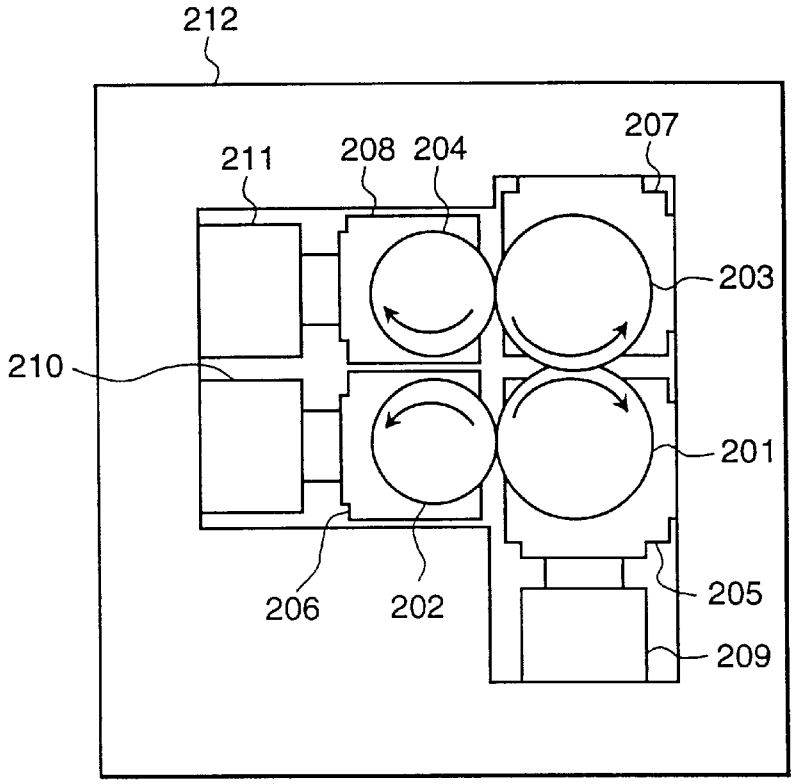
FIG. 13 is a schematic diagram for explaining an eighth embodiment of the present invention.

Next, an eighth embodiment of the present invention is explained, referring to FIG. 13.

In this embodiment, a rolling mill drive apparatus is constructed of four rollers in total of a drive roller and three driven rollers. In FIG. 13, a drive roller 201 is driven by an electric motor (not shown), a first driven roller 202 and a second driven roller 203 are arranged so as to be in contact with the drive roller 201. The second driven roller 203 is arranged to be in contact with a third driven roller 204, and the third driven roller 204 is arranged not to contact with the drive roller 201 and the first drive roller 202. The first and third rollers drive rolls similar to ones shown in FIG. 1 through spindles similar to ones shown in FIG. 1. Further, the drive roller 201 and the first, second and third driven rollers 202, 203, 204 are supported by bearing boxes 205, 206, 207 and 208, respectively, and the bearing boxes 205 to 208 are supported by a housing 212.

A contact load to be applied between the drive roller 201 and the second driven roller 203 is imparted by a hydraulic cylinder 209 which is a load imparting means, a contact load to be applied between the drive roller 201 and the first driven roller 202 is imparted by a hydraulic cylinder 210, and a contact load to be applied between the second driven roller 203 and the third driven roller 204 is imparted by a hydraulic cylinder 211. Thereby, allowable transmission torque can be set to any amount, for the first driven roller 202 by an output of the hydraulic cylinder 210 and for the third driven roller 204 by an output of the hydraulic cylinder 211.

In a case of the rolling mill drive apparatus as shown in FIGS. 1 and 2, since the load imparting means for imparting contact load between the drive rollers 1 and the two driven rollers 2, 3 is a hydraulic cylinder (actuator) common to them, in a case where any rolling trouble occurs such that frictional coefficient between any one of the pair of work rolls and rolling material becomes abnormally high and stick occurs, it can be considered that torque concentrates on only one of the work rolls and an excessive load is applied rapidly on the spindle. On the contrary, in the present embodiment, torque applied to the rolls can be adjusted individually, there is not the possibility that the torque concentrates on only one roll of the pair of rolls, and the concern that an excessive load is rapidly applied on the spindle disappears. Thereby, it is possible to protect the spindle.

That is, according to this embodiment, in addition to that similar effects to those of the first embodiment can be attained, allowable torque to the first and third driven rollers 202, 204 can be set to any value, respectively, so that even if any rolling trouble occurs, it is prevented that the torque concentrates on only one of the rolls and an excessive load is rapidly applied to the spindle, and it is possible to protect the spindle.

Further, in each of the above-explained embodiments, as mentioned above, lubrication between the rollers decrease remarkably the coefficient of friction as shown in FIG. 3 , so that it is unnecessary and impossible. However, it is desirable to supply water between the rollers, compared with the condition (dry condition) that nothing is supplied between the rollers. The reason is that although there is almost not a concern of heat generation between the rollers, the coefficient of friction becomes slightly larger and more stable by supplying water rather than nothing, fine powders made by wear, etc. are washed out by the water supply, and stable coefficient of friction can be maintained for a long time.

According to the present invention, since rotational power (torque) of the electric motor is transmitted to the rolling rolls, by using rollers without teeth, and without using any one of conventional gear type stands, marks do not occur on rolling material surfaces by errors in tooth shape, pitch errors, backlash, etc., and the quality of the rolling material surface can be raised.

Further, since transmission torque is made to disappear by releasing a contact load between the rollers in a moment according to a demand, in a case where a rolling trouble occurs, a rupture accident of the spindle, and a fatal damage accident such that work rolls are cut off in a half-moon shape in the backup roll or intermediate roll drive system can be prevented. Thereby, the time from a first use to the final use of the rolls can be greatly extended, it is possible to reduce cost and wear and tear expense. Further, even if releasing the contact load and braking of the rollers are delayed, the danger of spindle rupture can be decreased, so that work rolls of smaller diameter can be used, and it is possible to make the rolling facility more compact.

Further, even if work rolls of small diameter are used and the backup roll or intermediate roll drive system is used, a fatal rupture damage of the work rolls can be prevented, so that it is possible to roll hard and thin material at a high speed, the yield rate is raised and the productivity is improved.

Further, since the rollers after a contact load is released are braked, the rolling roll separated from the electric motor side is decelerated or stopped, and it is possible to largely suppress occurrence of cobbles and damage of various devices and apparatus.

Since the allowable torque, applied to the two driven rollers to which spindles are connected, is generated by individually imparting contact loads, even if any trouble occurs, there is no possibility that torque concentrates on only one of the rolls, and it is possible to protect the spindle.

Further, the present invention resides in a construction which utilizes a transmission ability of rotational power between the rollers with frictional force due to a contact load as much as possible, and does not operate under the condition that oil exists between the rollers, so that no loss occurs in the contact load applied between the rollers and the facility such as electric motor, etc. is not made large in scale and the cost is not made high, either.

Therefore, according to the present invention, it is possible to provide a rolling mill drive apparatus, a rolling mill and a rolling method, which is able to raise the quality of material surfaces, prevent a spindle rupture accident and a fatal damage of the rolls, increase rolling speed and reduce a cost.

What is claimed is:

1. A rolling mill drive apparatus for driving any rolls of a rolling mill which has a pair of work rolls, at least two intermediate rolls, and at least two backup rolls, said drive apparatus comprising:

a drive roller rotated by an electric motor;

a first driving roller contacting with said drive roller;

load imparting means for imparting a contact load between said drive roller and said first driven roller to rotate said first driven roller with frictional force caused by the contact load; and a first spindle drivingly connecting said first driven roller to one of said rolls of said rolling mill.

2. A rolling mill drive apparatus according to claim 1, further comprising:

a second driven roller contacting with said first driven roller, and a second spindle drivingly connecting the said driven roller with another of said rolls of said rolling mill.

3. A rolling mill drive apparatus according to claim 1, further comprising:

contact load interruption means for selectively interrupting the contact load of the load imparting means to thereby interrupt transfer of driving forces to the one of said rolls of said rolling mill.

4. A rolling mill drive apparatus according to claim 1, further comprising:

contact load interruptions means for selectively interrupting the contact load of the load imparting means to thereby interrupt transfer of driving forces to said rolls of said rolling mill.

5. A rolling mill drive apparatus according to claim 1, further comprising:

contact load adjusting means for adjusting said contact load during rolling according to rolling conditions.

6. A rolling mill drive apparatus according to claim 1, wherein said spindle is connected to both of said drive roller and said first driven roller, and wherein said apparatus further comprises:

a contact load interruption means for interrupting rotation transmitted from said electric motor to said first driven motor via said drive roller and the frictional force caused due to the contact load, by extinguishing the contact load from said load imparting means in a moment, according to a demand; and a brake means for rapidly decelerating the rotation due to inertia of said drive roller which became free from the contact load upon interruption of the contact load by said contact load interruption means.

7. A rolling mill drive apparatus according to claim 1, wherein the material of each of said drive roller and said first driven roller is the same as that of a high-speed steel roll.

8. A rolling mill drive apparatus according to claim 1, comprising:

a second driven roller and a third driven roller, wherein said first and second driven rollers are arranged so as to individually contact with said drive roller, and said third driven roller is arranged so as to contact with said second driven roller and not to contact with said drive roller and said first driven roller, wherein said load imparting means is arranged so as to be able to impart independently a contact load between said drive roller and said first driven roller and between said drive roller and said second driven roller, wherein a further load imparting means is provided for imparting a contact load between said second driven roller and said third driven roller, and rotating said third driven roller with frictional force caused due to the contact load, and wherein spindles are connected to both of said first and third driven rollers.

9. A rolling mill drive apparatus according to claim 2, further comprising:

contact load adjusting means for adjusting said contact load during rolling according to rolling conditions.

10. A rolling mill drive apparatus according to claim 3, further comprising a brake means for rapidly decelerating rotation of said one of said rolls of said rolling mill when said contact load interruption means interrupts the contact load of the load imparting means.

11. A rolling mill drive apparatus according to claim 3, further comprising:

a plate rupture detecting means for detecting an occurrence of plate rupture during rolling and operating said contact load interruption means on the basis of the detection result.

12. A rolling mill drive apparatus according to claim 4, further comprising brake means for rapidly decelerating rotation of said rolls of said rolling mill drivingly connected with the respective first and second spindles when said contact load interruption means interrupts the contact load of the load imparting means.

13. A rolling mill drive apparatus according to claim 4, further comprising:

a plate rupture detecting means for detecting an occurrence of plate rupture during rolling and operating said contact load interruption means on the basis of the detection result.

14. A rolling mill drive apparatus according to claim 12, further comprising:

a plate rupture detecting means for detecting an occurrence of plate rupture during rolling and operating said contact load interruption means on the basis of the detection result.

15. A rolling mill drive apparatus according to claim 4, further comprising:

contact load adjusting means for adjusting said contact load during rolling according to rolling conditions.

16. A rolling mill drive apparatus according to claim 4, further comprising:

a rotational speed difference detection means for detecting rotational speed of each of said driven rollers;

an operation control means for calculating a rotational speed difference between said driven rollers, and operating said contact load interruption means when the rotational speed difference exceed a predetermined value.

17. A rolling mill with two sets of rolling mill rolls and one rolling mill housing, each of said two sets of rolls being a roll group comprising a pair of work rolls and at least one pair of rolls supporting said pair of work rolls with at least one roll of each set being a driven roll, wherein a rolling mill drive assembly is provided for driving said driven rolls, said drive assembly including:

an electric motor driven drive roller, a driven roller in driving surface contact with the drive roller, and a spindle connecting the driven roller with one of said driven rolls.

18. A rolling mill according to claim 17, wherein said drive assembly includes:

a plurality of electric motor driven drive rollers, a corresponding plurality or respective driven roller in driving surface contact with the respective drive rollers, and a corresponding plurality of spindles connecting respective ones of the driven rollers with respective driven rolls of the sets of rolling mill rolls.

19. A rolling mill according to claim 17, comprising a contact load interrupter operable to immediately interrupt a contact load between the drive roller and driven roller to thereby stop drive of the driven rolls of the mill by way of the drive assembly.

20. A rolling mill according to claim 19, comprising a brake operable to rapidly decelerate the driven roller upon actuation of the contact load interrupter to interrupt the contact load between the drive roller and driven roller.

21. A rolling mill according to claim 20, wherein the contact load interrupter includes a hydraulic system releasing force on said drive roller and driven roller and a spring biasing said drive roller and driven roller toward an out of contact position.

22. A rolling mill drive assembly for driving a first rolling mill roll, comprising:

an electric motor driven drive roller, a first driven roller drivingly contacted with said drive roller, a contact imparter which in use imparts a contact load between the drive roller and the first driven roller, and a spindle connectible between the first driven roller and the rolling mill roll.

23. A rolling mill drive assembly according to claim 22, wherein said contact imparter includes a hydraulically actuable piston which selectively forces the drive roller and first driven roller against one another.

24. A rolling mill drive assembly according to claim 23, further comprising a spring interposed to force the drive roller and first driven roller toward a position out of driving contact with one another.

25. A rolling mill including:

a first rolling mill driven roll which is rotatably driven during rolling operations, and a rolling mill drive assembly rotatably driving the first rolling mill driven roll, said drive assembly comprising:

an electric motor driven first drive roller, a first driven roller drivingly contacted with said drive roller, contact imparter which in use imparts a contact load between the drive roller and the first driven roller, and a spindle connectible between the first driven roller and said first rolling mill roll.

26. A rolling mill according to claim 25, comprising a second rolling mill driven roll, wherein said drive assembly includes:

a second driven roller in driving contact with said first drive roller, and a second spindle connectible between the second driven roller and said second driven roll.

27. A rolling mill according to claim 25, wherein said rolling mill is a cluster type mill and said first driven roll is one of a plurality of driven rolls.

28. A rolling method comprising:

supplying strip material to a rolling mill having a first driven roll which is rotatably driven during rolling operations, and rotatably driving said first driven roll utilizing a drive assembly comprising:

an electric motor driven drive roller, a first driven roller selectively drivingly contacted with said drive roller, a contact imparter which in use imparts a contact load between the drive roller and the first driven roller, and a spindle connectible between the first driven roller and said first drive roll, detecting an occurrence of plate rupture during strip material rolling operations, and selectively interrupting the contact load between the drive roller and driven roller to thereby stop rolling operations upon detection of a plate rupture.

29. A rolling method according to claim 28, comprising adjusting the contact load between the drive roller and the first driven roller during rolling by utilizing contact load adjusting means.

30. A rolling method according to claim 28, comprising selectively interrupting the contact load between the drive roller and driven roller to thereby stop rolling operations.

* * * * *